US005385107A

United States Patent [19]

Borgne

[11] Patent Number: 5,385,107

[45] Date of Patent: Jan. 31, 1995

[54] DEVICE FOR GUIDING A STRIP OF FABRIC TO PROXIMITY TO THE NEEDLE OF A SEWING MACHINE TO FORM A BORDER

[76] Inventor: Jean-Claude Borgne, 7 bis, Chemin de Maraye Les Vergers, 10120 Saint Andre, France

[21] Appl. No.: 949,814

[22] PCT Filed: Jun. 11, 1991

[86] PCT No.: PCT/FR91/00463

§ 371 Date: Dec. 9, 1992

§ 102(e) Date: Dec. 9, 1992

[87] PCT Pub. No.: WO91/19847

PCT Pub. Date: Dec. 26, 1991

[30] Foreign Application Priority Data

Jun. 12, 1990 [FR] France ..... 90/07289

[51] Int. Cl.[6] ..... D05B 35/06

[52] U.S. Cl. ..... 112/138

[58] Field of Search ..... 112/137, 138, 152, 153, 112/147, 143

[56] References Cited

U.S. PATENT DOCUMENTS

| | | | |
|---|---|---|---|
| 2,278,043 | 3/1942 | Sailer . | |
| 2,428,952 | 10/1947 | Ackerman | 112/138 |
| 2,506,325 | 5/1950 | Ackerman | 112/138 |
| 4,744,317 | 5/1988 | Cullen et al. | 112/138 |

*Primary Examiner*—Clifford D. Crowder
*Assistant Examiner*—Paul C. Lewis
*Attorney, Agent, or Firm*—Lerner, David, Littenberg, Krumholz & Mentlik

[57] ABSTRACT

The device according to the invention, which is used to make a border or a collar on the edge of a piece of fabric, defines a U-shaped channel the end (14) of which is seen in the figures, which is delimited by an outside wall (17) and an inside wall (18), the wall (18) being mobile with respect to the wall (17) so that the device can thereby be adjusted to different strip widths (4).

22 Claims, 1 Drawing Sheet

DEVICE FOR GUIDING A STRIP OF FABRIC TO PROXIMITY TO THE NEEDLE OF A SEWING MACHINE TO FORM A BORDER

This invention concerns what is commonly called, in the sewing field, an attachment. More precisely, this attachment is meant to shape a strip of fabric and to bring it folded to the proximity of the needle of a sewing machine to form a decorative border on the edge of a piece of fabric.

An accessory intended to form a border is generally called a border maker and has a body for guiding the strip of fabric in which the strip arrives flat, is gradually furrowed to form a U while one of its two edges are gradually lifted to form, at the base of the branches of the U, what is commonly called the tucks. At the outlet of this guide body, the strip of fabric is drawn perpendicularly to its trajectory, to turn back on itself around ridges that constitute the beveled end of the guide body. The U thus formed is completely turned upside down, so that the tucks which, in the guide body, were situated at the end of the branches of the U, are now inside the branches of this U, which comes at the same time to overlap the piece of fabric just in front of the needle of the sewing machine.

FIG. 1A in the attached drawings shows, in cross-section, the strip of fabric B possessing two creases R and overlapping the edge of a piece of fabric T just before it passes under the needle of a sewing machine C.

All known devices for performing this type of operation are generally specialized and adapted to a specific type of border (with one or two tucks of specific size, able to accommodate and guide only one specific fabric strip width. . .) with the result that it is necessary to have a large number of accessories to perform several sewing operations of this type.

This invention intends to remedy this problem of the multiplicity of a accessories by proposing a guiding device that makes it possible, by simple means, to adapt a single accessory to do various jobs.

For this purpose, the invention concerns a device for guiding a strip of fabric to the proximity of the needle of a sewing machine, intended to impress in this strip a crease on itself to form a border overlapping the edge of a piece of fabric. This device includes, in a known manner, a body for guiding the strip with an inlet part and a shaping part, which shaping part contains outside wings for lifting the edges of the strip, which converge in the direction in which this strip is moving, and a middle part that defines a U-shaped channel, the branches of which are increasingly large and increasingly close to each other in the direction in which the strip is moving, this channel being delimited by an outside wall and an inside wall, which is roughly parallel to it. According to one of the main characteristics of the invention, the inside wall is mobile with respect to the outside wall, in the symmetry plane of the channel and in a direction roughly perpendicular to the bottom of the U.

In one particularly simple method of realizing the invention, the inside wall of the U-shaped channel contains an elastically flexible blade, forming the back of the U, this blade being embedded at one of its ends in the inlet to the body, and its other end resting on a mobile abutment within the outside wall of the U.

This abutment is preferably staple-shaped, the back of which is in contact with the flexible blade, the branches of which are parallel to the branches of the outside wall and which possesses a slide-shaped rear part housed in a fixed groove in the guide body.

In order to be able to adjust the position of the abutment with respect to the bottom of the U-shaped outside wall, this slide forms a ratchet that meshes with a toothed wheel carried by the guide body and connected to a drive button.

Just as in known devices, the outlet end of the guide device is beveled to enable the strip to turn back onto these edges slantwise, the front edge of the branches of the outside wall of the U-shaped channel and the front edge of the wings of the staple are inclined on the longitudinal axis of the guide body, and the slide and the groove are parallel to these edges. In this manner, the ridges around which the strip of fabric is turned back are always situated in the same place regardless of the position of the staple in the depth of the U formed in the guide device.

To adapt the guide device to multiple strip widths, the inlet part of the guide body contains lateral borders that are adjustable to the width of the strip. This adjustment also makes it possible to modify the centering of a strip in the guide device and thereby to create borders with asymmetrical tucks or even a single tuck.

Lastly, in the device according to the invention, as in known devices, the convergent ends of the wings that lift the edges of the fabric delineate, with the U-shaped outside wall, an outside passage for guiding the tucks. It is advantageous for this passage to have an abutment for adjusting the height of these tucks.

Other characteristics and advantages will be apparent from the following description of one method of realizing the invention.

During this description, reference will be made to the attached drawings, in which:

FIG. 1A, as stated above, is a cross-section of a border made with an accessory known in the field to which the invention relates.

Figures 1A, 1B, 2, 3:
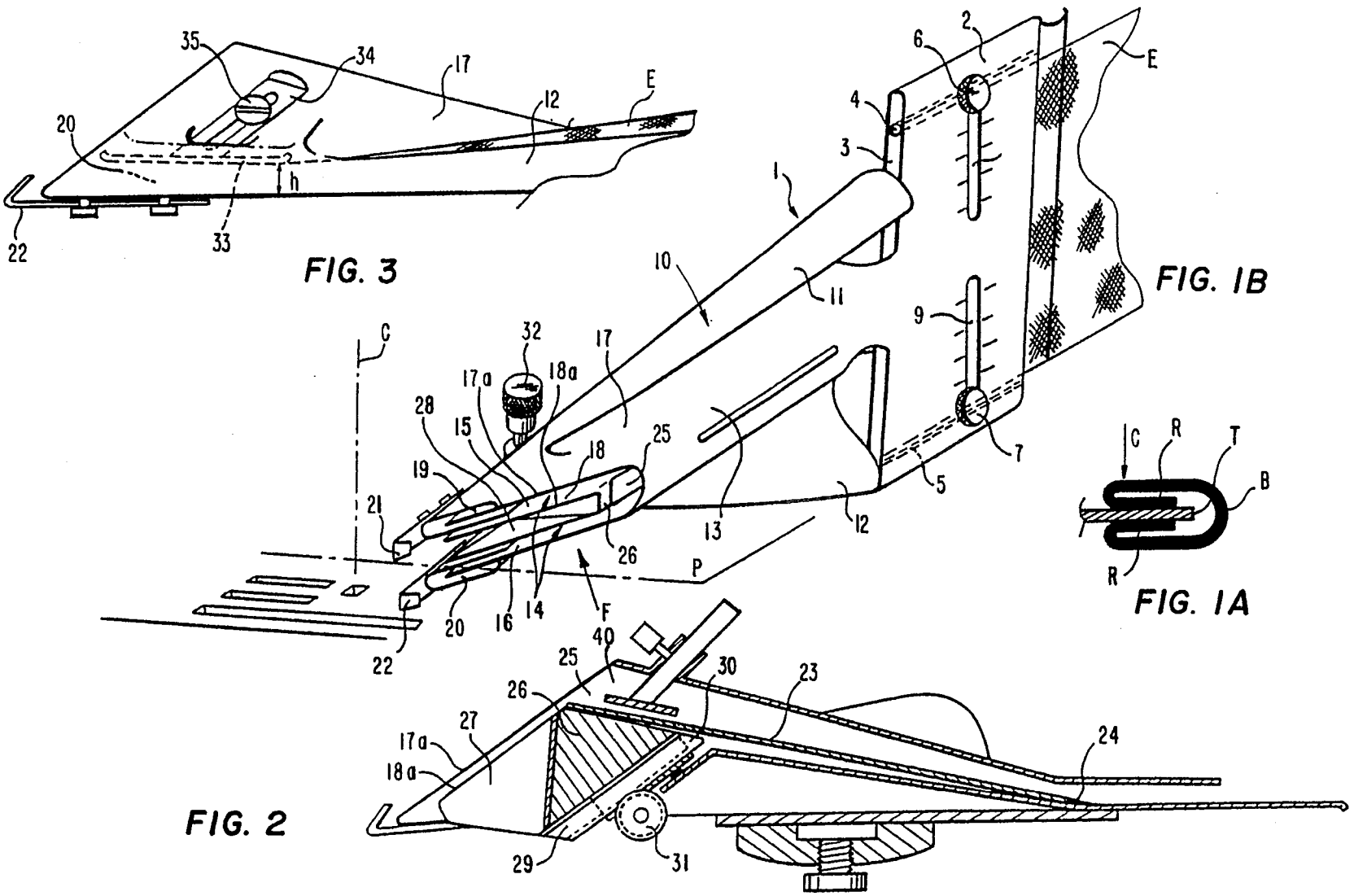
FIG. 1B is a general view, in perspective, of the device according to the invention placed in proximity to a sewing machine needle.
FIG. 2 is a cross section view of the device in FIG. 1B of its symmetry plane P.
FIG. 3 is a partial outside view from F of the device according to FIG. 1B showing a design detail.

The guide body 1 of the device according to the invention has an inlet part 2 that defines a flat channel 3 into which a strip E can be introduced. The width of this channel 3 is delimited by the lateral edges 4 and 5 which are mobile inside part 2 and adjustable in terms of position by means of a blocking button 6, 7 which can be moved, with the lateral edges, along slots 8 and 9 which possess lateral graduated markings.

As in conventional devices, the strip E at the outlet of the inlet part 2 of the guide body, is gripped by a shaping part 10 which has two lateral wings 11 and 12 that converge to lift the edges of the strip E, and a central portion 13 which defines a U-shaped channel, of which only the outlet end 14 is visible in FIG. 1B. It is also at this outlet end 14 that the branches 15 and 16 of this U are the closest together and the longest, at the end of the part 10 next to the inlet part 2, this U being very flattened. Therefore, the cross-section of this channel is such that the strip E is gradually folded back on itself.

This channel is delimited by an outside wall 17 and an inside wall 18.

Also after the fashion of known devices, the walls 17 and 18, on the end 14 side of the channel, possess inclined edges 17*a* and 18*a*, roughly in the same plane, the role of which will be explained below.

Also in a known manner, the convergent ends of the wings 11 and 12 are joined to the outside wall 17 of the U to delimit tuck-passage channels 19 and 20.

Facing the channel zone common to the branches of the U and the channels 19 and 20, the device also has, in a known manner, claws 21 and 22 that help to turn back the fabric as it leaves the guide device. These claws 21 and 22 are adjustable in terms of position with respect to the outlet of the channels 19 and 20.

As stated earlier, the principle of forming a border with tucks using a device such as the one described in the figures, consists (at the outlet of the guide device that made it possible to give the strip of fabric a U shape with one or two outside tucks at the ends of the branches of this U) of having this shaped strip pass over the ridges 18*a* as concerns the U-shaped part of the strip and over the end of ridges 17*a* as concerns the turn-backs formed in the channels 19 and 20, by drawing the strip perpendicularly to its direction of movement in the guide device. Under these conditions, the curve of the U is inverted and the turn-backs that were situated outside this U are placed inside and form tucks R as shown in FIG. 1A, the device being placed roughly perpendicular to the cutting table and perpendicular to the trajectory of the fabric edge to be bordered, it is then sufficient to introduce this fabric edge T into the border thus formed and to pierce it with the needle C.

FIG. 2 shows that the inside wall 18 of the U-shaped channel of the guide device has an elastically flexible blade 23 forming the inside wall of the bottom of this U, this blade being embedded at its end 24 in the bottom plate of the inlet part 2 of the guide body, while its free end 25 rests on an abutment 26 which is mobile, roughly perpendicular to the bottom of the U, in the symmetry plane P of the device. This abutment 26 is staple-shaped and thereby carries the two wings 27 and 28, the front edges of which comprise the edges 17*a* and 18*a* respectively, for turning back the fabric which can pass between them. Behind this staple and parallel to the edge 18*a*, the abutment 26 carries a slide 29 which can slip into a groove 30 belonging to the guide body. This groove 30 has an opening in its bottom which permits a toothed wheel 31 to mesh with the teeth that the slide has 29. The ratchet thereby realized makes it possible to lift or lower the end 25 of the blade 23 and thereby to adjust the ultimate length of the branches of the U in which the strip E is shaped. This adjustment is obtained by pressing a button 32 for driving the toothed wheel 31. It is thereby possible to make borders B of varying widths, and therefore to introduce strips of fabric of varying widths into the device. Also, because of the adjustable edges 4 and 5, it is possible to center or decenter the strip E of a given width so that, ultimately, one or two tucks are made according to the decentered or centered position of the strip with respect to the device.

To improve the regularity of the height of the tucks, it is possible to place, in channels 19 and 20, an abutment 33 (see FIG. 3) that makes it possible to adjust the height h of the tuck introduced into the channels 19 and 20 by the wings 11 and 12. This abutment 33 can be adjusted using a drive arm 34 blockable by means of a screw 35 on the outside wall 17 of the channel U.

In short, FIG. 2 shows the presence of an upper plate 40 which is adjustable with respect to the end 25 of the blade 23, which makes it possible to contain the "wave" formed by the fabric when it curves back on itself.

The invention has the advantage of offering a single accessory for many fabric strip widths. As an indication, an accessory according to the invention, with dimensions equivalent to one of the known accessories, intended for a strip of a given width, can receive a strip of fabric approximately twice as wide.

The above also described the application of the invention to a border maker. However, it is noteworthy that this applies to many other accessories, such as collar guide, for stitcher, collar guide with picot passage, guides on triple-drive machine, ladder mending . . . with, for all these devices, the same advantages as those described above.

I claim:

1. An apparatus for forming a border from a fabric, said apparatus comprising:

a body having guide means for guiding said fabric, and shaping means connected to said guide means and being arranged to receive said fabric from said guide means for folding said fabric so that said border can be formed, said shaping means including a plurality of wings, at least two of said plurality of wings being spaced from each other and being arranged to converge from a receiving end disposed to receive said fabric from said guide means to a remote end spaced from said receiving end so that said fabric is caused to fold as it is drawn from said receiving end to said remote end of said plurality of wings, said shaping means further including a U-shaped channel arranged to receive said fabric from said remote end of said wings and to cause said fabric to obtain a U-shaped configuration, said U-shaped channel including an outside wall and an inside wall extending generally parallel to said outside wall, said outside wall and said inside wall being relatively movable with respect to each other for selective adjustment of said U-shaped channel, and tuck forming means arranged adjacent said U-shaped channel for causing at least one end of said fabric to become folded within said U-shaped configuration so that said folded fabric can subsequently be sewn to a further fabric to form a border thereon.

2. The apparatus of claim 1 wherein said outside wall of said U-shaped channel is fixed and said inside wall of said U-shaped channel is selectively movable toward and away from said outside wall.

3. The apparatus of claim 2 wherein said inside wall of said U-shaped channel includes an abutment forming a back portion thereof, and a flexible blade having a first end extending outside of said U-shaped channel and being connected to said guide means, and a second end freely arranged on said abutment for selective movement with respect to said U-shaped channel.

4. The apparatus of claim 3 wherein said abutment includes a staple-shaped configuration including a central portion, and first and second branches extending generally parallel to said outside wall of said U-shaped channel, said flexible blade arranged adjacent said central portion, said abutment further including slide means for selectively adjusting the dimensions of said U-shaped channel so that the size of said border to be formed can be modified.

5. The apparatus of claim 4 wherein said body includes a groove, said slide means having teeth thereon and being at least partially arranged within said groove, said apparatus further comprising a toothed wheel adapted for engagement with said teeth on said slide means so that said abutment can be selectively adjusted to accommodate various sized fabrics and to form various sized borders.

6. The apparatus of claim 5 further comprising a drive button for controlling movement of said toothed wheel and thus selective adjustment of said slide means.

7. The apparatus of claim 5 wherein said outside wall of said U-shaped channel includes a front edge and said first and second branches of said abutment also includes front edges extending generally parallel to said front edge of said outside wall, said slide means and said groove also being generally parallel to said front edge of said outside wall.

8. An apparatus for forming a border from a fabric, said apparatus comprising:

a body having guide means for guiding said fabric, and shaping means connected to said guide means and being arranged to receive said fabric from said guide means for folding said fabric so that said border can be formed, said shaping means including a plurality of wings, at least two of said plurality of wings being spaced from each other and being arranged to converge from a receiving end disposed to receive said fabric from said guide means to a remote end spaced from said receiving end so that said fabric is caused to fold as it is drawn from said receiving end to said remote end of said plurality of wings, said shaping means further including a U-shaped channel arranged to receive said fabric from said remote end of said wings and to cause said fabric to obtain a U-shaped configuration, said U-shaped channel including an outside wall and an inside wall extending generally parallel to said outside wall, said outside wall and said inside wall being relatively movable with respect to each other for selective adjustment of said U-shaped channel, and tuck forming means arranged adjacent said U-shaped channel for causing at least one end of said fabric to become folded within said U-shaped configuration so that said folded fabric can subsequently be sewn to a further fabric to form a border thereon, said tuck forming means including at least one outside passage and adjustable abutment means arranged within said at least one outside passage for adjusting said tuck.

9. The apparatus of claim 8 wherein said outside wall of said U-shaped channel is fixed and said inside wall of said U-shaped channel is selectively movable toward and away from said outside wall.

10. The apparatus of claim 9 wherein said inside wall of said U-shaped channel includes an abutment forming a back portion thereof, and a flexible blade having a first end extending outside of said U-shaped channel and being connected to said guide means, and a second end freely arranged on said abutment for selective movement with respect to said U-shaped channel.

11. The apparatus of claim 10 wherein said abutment includes a staple-shaped configuration including a central portion, and first and second branches extending generally parallel to said outside wall of said U-shaped channel, said flexible blade arranged adjacent said central portion, said abutment further including slide means for selectively adjusting the dimensions of said U-shaped channel so that the size of said border to be formed can be modified.

12. The apparatus of claim 11 wherein said body includes a groove, said slide means having teeth thereon and being at least partially arranged within said groove, said apparatus further comprising a toothed wheel adapted for engagement with said teeth on said slide means so that said abutment can be selectively adjusted to accommodate various sized fabrics and to form various sized borders.

13. The apparatus of claim 12 further comprising a drive button for controlling movement of said toothed wheel and thus selective adjustment of said slide means.

14. The apparatus of claim 12 wherein said outside wall of said U-shaped channel includes a front edge and said first and second branches of said abutment also includes front edges extending generally parallel to said front edge of said outside wall, said slide means and said groove also being generally parallel to said front edge of said outside wall.

15. An apparatus for forming a border from a fabric, said apparatus comprising:

a body having guide means for guiding said fabric, said guide means including adjustment means for facilitating the guidance of various sized fabrics, and shaping means connected to said guide means and being arranged to receive said fabric from said guide means for folding said fabric so that said border can be formed, said shaping means including a plurality of wings, at least two of said plurality of wings being spaced from each other and being arranged to converge from a receiving end disposed to receive said fabric from said guide means to a remote end spaced from said receiving end so that said fabric is caused to fold as it is drawn from said receiving end to said remote end of said plurality of wings, said shaping means further including a U-shaped channel arranged to receive said fabric from said remote end of said wings and to cause said fabric to obtain a U-shaped configuration, said U-shaped channel including an outside wall and an inside wall extending generally parallel to said outside wall, said outside wall and said inside wall being relatively movable with respect to each other for selective adjustment of said U-shaped channel, and tuck forming means arranged adjacent said U-shaped channel for causing at least one end of said fabric to become folded within said U-shaped configuration so that said folded fabric can subsequently be sewn to a further fabric to form a border thereon.

16. The apparatus of claim 15 wherein said guide means includes a first lateral edge and a second lateral edge remote from said first lateral edge and being generally parallel thereto, said adjustment means being operatively connected to said first and second lateral edges to permit said first and second lateral edges to be moved closer or further from each other.

17. The apparatus of claim 16 wherein said outside wall of said U-shaped channel is fixed and said inside wall of said U-shaped channel is selectively moveable toward and away from said outside wall.

18. The apparatus of claim 17 wherein said inside wall of said U-shaped channel includes an abutment forming a back portion thereof, and a flexible blade having a first end extending outside of said U-shaped channel and being connected to said guide means, and a second end freely arranged on said abutment for selective movement with respect to said U-shaped channel.

19. The apparatus of claim 18 wherein said abutment includes a staple-shaped configuration including a central portion, and first and second branches extending generally parallel to said outside wall of said U-shaped channel, said flexible blade arranged adjacent said central portion, said abutment further including slide means for selectively adjusting the dimensions of said U-shaped channel so that the size of said border to be formed can be modified.

20. The apparatus of claim 19 wherein said body includes a groove, said slide means having teeth thereon and being at least partially arranged within said groove, said apparatus further comprising a toothed wheel adapted for engagement with said teeth on said slide means so that said abutment can be selectively adjusted to accommodate various sized fabrics and to form various sized borders.

21. The apparatus of claim 20 further comprising a driving button for controlling movement of said toothed wheel and thus selective adjustment of said slide means.

22. The apparatus of claim 20 wherein said outside wall of said U-shaped channel includes a front edge and said first and second branches of said abutment also includes front edges extending generally parallel to said front edge of said outside wall, said slide means and said groove also being generally parallel to said front edge of said outside wall.

* * * * *